United States Patent [19]

Huber

[11] Patent Number: 4,909,397

[45] Date of Patent: Mar. 20, 1990

[54] FILE SUPPORT APPARATUS

[75] Inventor: Alfred W. Huber, Schwenksville, Pa.

[73] Assignee: Pathfinder Vue-File Systems, Inc., Schwenksville, Pa.

[21] Appl. No.: 83,167

[22] Filed: Aug. 10, 1987

[51] Int. Cl.[4] ..... A47F 5/00

[52] U.S. Cl. ..... 211/46; 211/59.1; 211/94.5; 312/184

[58] Field of Search ..... 211/57.1, 59.1, 50, 211/46, 94, 94.5; 312/184

[56] References Cited

U.S. PATENT DOCUMENTS

| | | | |
|---|---|---|---|
| 1,291,001 | 1/1919 | Horwitz | 402/30 X |
| 1,421,099 | 6/1922 | Reed | 211/59.1 X |
| 3,359,986 | 12/1967 | Koenders | 211/46 |
| 4,009,784 | 3/1977 | Elias et al. | 211/46 |
| 4,674,637 | 6/1987 | Lovelock et al. | 211/46 |
| 4,718,562 | 1/1988 | Winkler | 211/94.5 |

FOREIGN PATENT DOCUMENTS

| | | | |
|---|---|---|---|
| 474281 | 3/1929 | Fed. Rep. of Germany | 312/184 |
| 1285569 | 1/1962 | France | 312/184 |

*Primary Examiner*—Robert W. Gibson, Jr.
*Attorney, Agent, or Firm*—Joseph W. Molasky & Assosc.

[57] ABSTRACT

A wall-mounted file system consisting of a plurality of horizontally disposed rods which provide a suspension means for envelopes which are serially arranged in a single row or several rows. Each envelope includes a slotted opening for access purposes and there is appended to the top edge thereof a horizontally disposed passageway for receiving a dual-hooked bar from which each envelope is hung. Recessed segments within said bar incline downwardly and lead to the hook members so that envelopes can be added and removed with ease.

8 Claims, 3 Drawing Sheets

FILE SUPPORT APPARATUS

This invention relates to a novel file suspension system.

More specifically, this invention relates to an assembly comprised of a support from which receptacles in the form of envelopes are suspended one behind the other to provide storage means.

One embodiment consists of a wall-mounted shelf in which the underside is equipped with rods for serially suspending several rows of envelopes in a side-by-side relationship. This assembly is detachable but it is most suitable in locations where existing set-ups are not to be routinely moved.

A second embodiment relates to a wall-mounted assembly in which envelopes are suspended one behind the other in a single row. This apparatus is easily detachable and it is ideal for creating new work stations and floor space.

Another embodiment consists of an assembly which is installed as a fixture between two vertically disposed parallel supports. In this system the envelopes are arranged serially in a single row to provide a compact assembly which can be installed in areas which are small or narrow as, for example, within a closet or cabinet or beneath a counter. It is ideal for transforming unusable space into a productive work area.

Another point of novelty resides in the receptacle per se. This item consists essentially of an envelope equipped with an opening for inserting and removing documents and the topmost edge includes a passageway for receiving a dual-hooked bar which is slidably inserted to provide suspension means.

BACKGROUND

There are several systems available for facilitating document storage and retrieval.

The lateral filing system is best known because it combines enhanced efficiencies with the ability to secure file documents within cabinets equipped with locking facilities. Moreover, lateral filing cabinets can be stacked one on top of another to provide an efficient use of vertical space and they complement the office environment by serving as dividers or the like.

Lateral files are equipped with roll out drawers in which hanging folder frames can be installed to accommodate both letter size and legal size file folders in a suspended mode. The cabinets are equipped with heavy-duty suspension systems so that the drawers can be drawn out completely to provide total access.

In spite of its advantages the lateral system is not without problems because it requires not only cabinet space but sufficient room for fully extending the pull-out drawers.

Moreover, the lateral system does not afford immediate access to needed data because the documents are housed within cabinets and the user cannot see at a glance the file which is to be retrieved.

To overcome this difficulty alternate systems have been developed. One alternative is the open-file suspension system in which file folders are allowed to hang from racks in open view. This system places the documentation within open folders which are readily accessible so that work material can be stored and retrieved as rapidly and efficiently as possible.

The folders are hung continuously on support bars which are placed wherever two vertically disposed parallel supports can be found. The sides of the folder serves as dividers and gravity forces the contents of the file into an upright position. Access is had by spreading the sides of the folder apart to form a "V" and closure is achieved by simply bringing the sides together.

Unfortunately for this system the individual file folders cannot be easily removed and their open sides can result in documents becoming lost. Moreover, the suspended folders can only be viewed along one edge and there is no space available for indicia or the like to identify the file contents.

One variation on the foregoing is the "Grafi'System" manufactured by Jalema b.v. of the Netherlands. This system provides job bags which are suspended on a T-bar at a single point. The suspension is such that the job bags can be rotated slightly to view the face of the file but only up to angles of about 35° and they are removed by oscillating same to disengage a recessed hook assembly affixed to the top of the bag.

Unfortunately, the "Grafi-System" is not the answer to fast and efficient information retrieval because the job bags cannot be viewed face-on and the suspension system is so intricate that it creates more problems than it solves.

Accordingly, there is a need for an inexpensive file system in which folders can be arranged face-forward in full view and can be moved from one location to another without difficulty thereby totally decentralizing the working file management operation.

THE INVENTION

It is an object of this invention to provide a detachable file system which can be mounted onto a vertical support such as a wall to create a work station or to complement existing facilities.

Another object is to provide a system which, in addition to its file storing capabilities, is also equipped with a shelf for supporting work related equipment.

Still another object is to provide an alternative file system which can be mounted between adjacent vertical supports. This assembly is particularly suitable for installation on parallel supports where the area to be served is so small as to be unsuitable for other purposes.

A further object consists of an envelope and a dual-hooked bar which, in combination, serve as a depository for the material which is sought to be stored.

In general, the apparatus of this invention consists of a wall-mounted structure equipped with a plurality of horizontally disposed rods to provide a suspension means for envelopes which are serially arranged either in a single row or in a plurality of rows.

The envelopes are flat and possess a slotted opening near the top for access purposes. Appended to the top edge is a horizontally disposed passageway for receiving a dual-hooked hanger bar from which the envelopes are suspended. Recessed segments within said bar incline downwardly and lead to hook assemblies which are brought into sliding engagement with said rods so that in its assembled mode the rods are within the hook. This arrangement makes document retrieval fast and convenient because the rods slide smoothly in and out of the hook in tandem so that envelopes can be added or removed without difficulty.

A preferred embodiment of this invention consists of a file suspension assembly equipped with a utility shelf and opposing sidewalls. Joined to the shelf is a vertically disposed back panel which extends downwardly beyond the underside of said shelf to provide support means for several pairs of horizontally disposed rods arranged in series. These rods are joined to the back panel by any suitable means and they extend outwardly to engage at their opposite ends a downwardly extending L-shaped flange which is joined by its base to the underside of said shelf. The rods may be secured to said back panel by any variety of means such as welding, screws or frictional engagement but screw means is preferred. Meanwhile, at their opposite end, the rods are held in place by frictionally engaging accommodating apertures in the L-shaped member.

The file assembly and shelf may be formed from any suitably rigid sheet material such as metal or plastic but metal such as steel or aluminum is preferred. And although this invention is subject to design modification it is most desirable to form the shelf and its sidewalls as a unitary piece which can then be joined to the back panel by welding or other suitable means.

Another aspect of this invention provides for a combination file and shelf assembly in which the latter extends outwardly and then downwardly to form a vertically depending flange or lip behind which a lamp may be installed so that the wall-mounted unit can serve as a lighted work station. In addition the surface of said flange can serve as a support upon which instructions or other indicia can be adhesively secured.

Joined to the back panel of this assembly is a preformed sheet of resilient material such as polyethylene plastic or foam rubber for cushioning the apparatus and installation is achieved by hanging same on screws or bolts anchored into the vertical support via apertures in the back panel.

An alternative assembly according to this invention consists of a unitary member of inverted U-shaped cross section. This member is equipped with a single pair of rods upon which envelopes are suspended serially in a single row. No shelf is provided. Structurally, this apparatus consists of an essentially flat top to which is joined a flat vertically disposed back panel equipped with apertures for hanging the assembly onto wall anchored bolts or screws and a vertically disposed front panel. Included in said back panel and front panel are apertures for receiving a pair of horizontally disposed rods upon which the file envelopes and their bar assembly are suspended. In their assembled mode the horizontally disposed rods extend at one end through the apertures of the front panel and they are secured at their opposite ends to the back panel via the screw means described hereinbefore for the shelf-containing assembly. The installation and removal of this assembly is facilitated by a finger-insertable cutout centrally disposed at the juncture of the top section and vertically disposed front panel.

Although this assembly contains only one pair of file suspension rods this limitation makes the device suitable for rapid installation and ease of removal so that the entire system can be moved from one location to another in a convenient manner. Moreover, several such assemblies can be placed adjacent to one another to create in any one location a more complete work station.

Another variation on this invention consists of a file suspension assembly which can be mounted between two vertically disposed parallel supports. In this embodiment two identical rod-engaging plates of generally U-shaped cross section equipped with rod-engaging apertures are mounted opposite one another and a pair of horizontally disposed rods are secured within said apertures to afford a file assembly which holds a single row of serially arranged file folders. Unlike the embodiments described hereinbefore, this assembly is not meant to be readily detachable and it is wall mounted for more-or-less permanent installation.

The envelopes employed with the support structure of this invention include cutout segments and they are disposed in such manner as to come into registry with the recessed hook members of the hanger bar when the latter is inserted into the appended passageway along the top most edge of the envelope. This disposition of the envelope and hanger bar allows the user to smoothly slide said bar onto the horizontally disposed rods so that individual envelopes can be stored and retrieved rapidly and efficiently.

The size and shape of the envelopes is not critical and their configuration of the envelopes can be varied to accommodate the sheet material which is to be stored. However, a preferred embodiment of this invention provides for an envelope which is constructed of transparent plastic so that the contents of the envelope can be readily viewed. In addition, the face of the envelope may also contain a transparent pocket into which a label, tab or other indicia may be inserted for identification purposes.

These and other aspects of the invention will be made more apparent from the following detailed description of the drawings and preferred embodiments.

THE DRAWINGS

PREFERRED EMBODIMENTS

Figure 1:
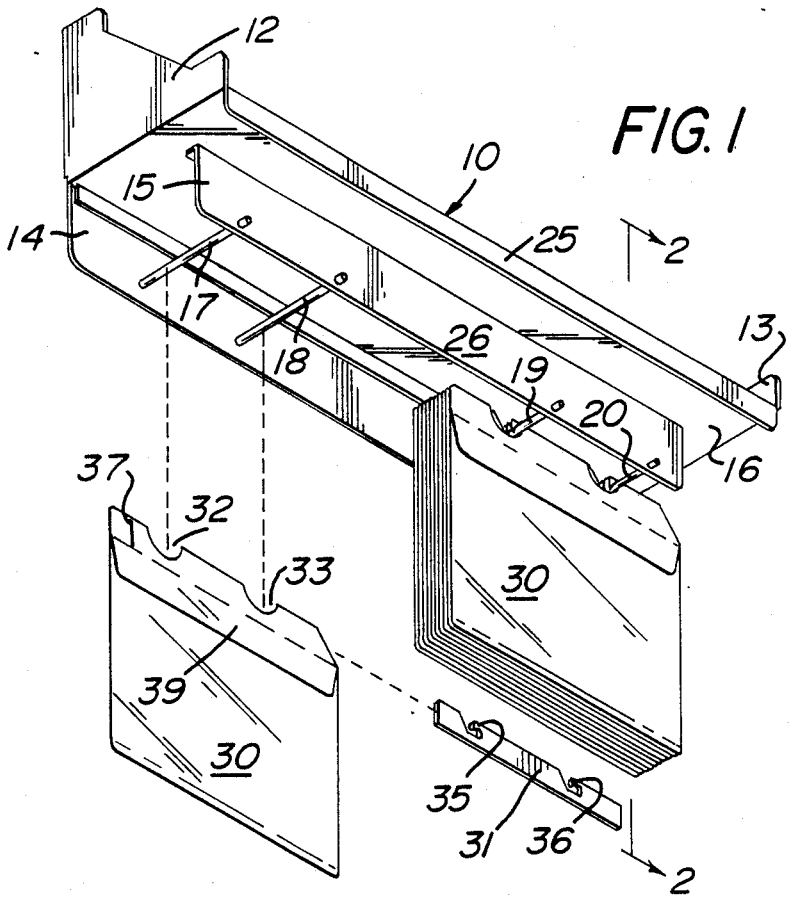
FIG. 1 is a perspective view of a combination shelf and file assembly in accordance with this invention.
Figure 2:
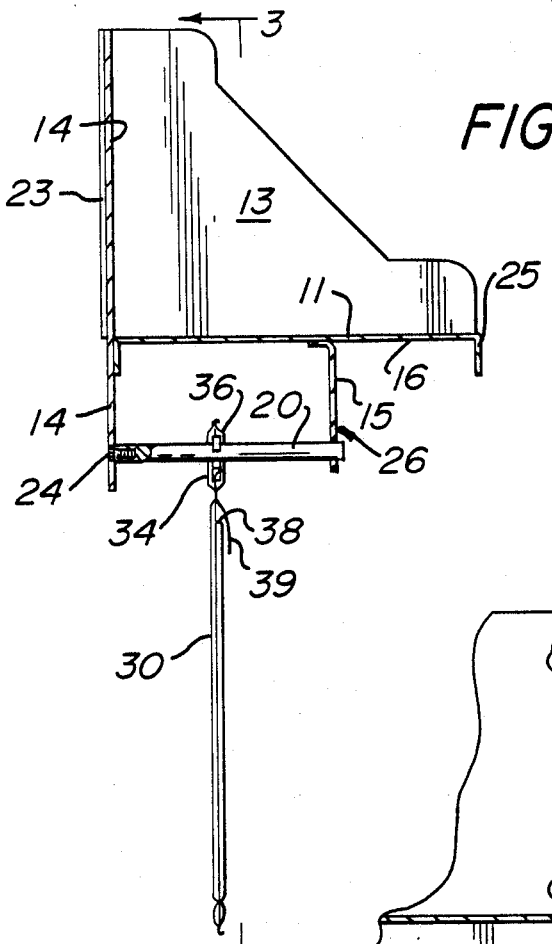
FIG. 2 is a side sectional view taken along line 2—2 of FIG. 1.
Figure 3:
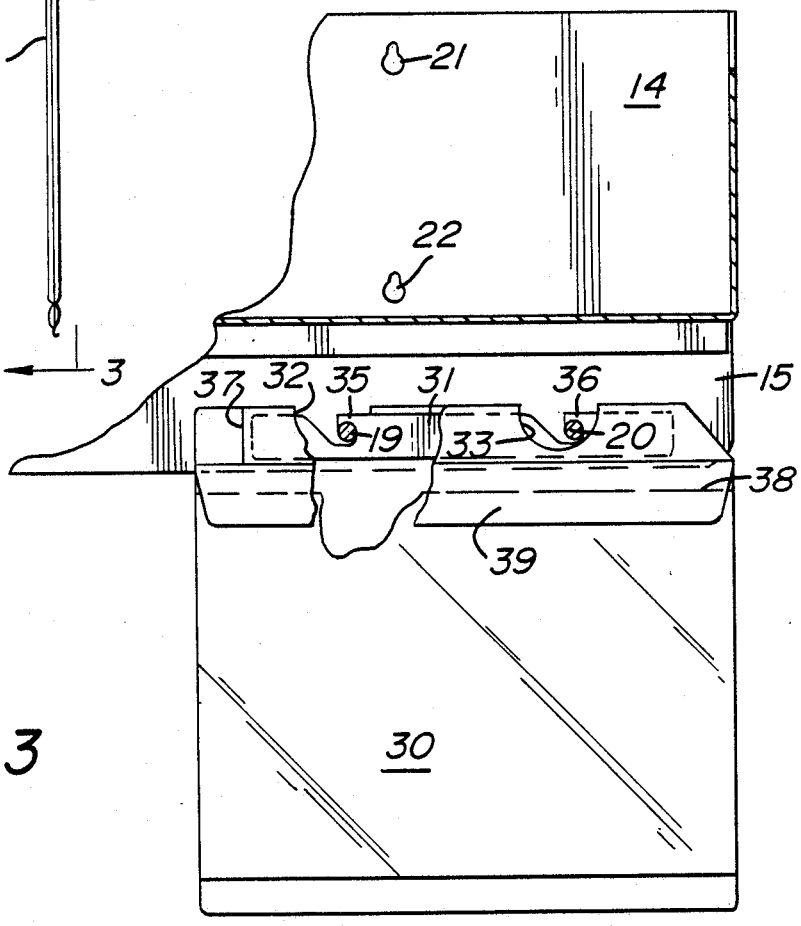
FIG. 3 is a fragmentary sectional view taken along line 3—3 of FIG. 2.

There is shown in FIGS. 1–3 the combination of a shelf and file support system. This set-up 10 includes a horizontally disposed shelf 11, two parallel sidewall members 12 and 13 and a vertically oriented back panel 14 equipped with apertures 21 and 22 for releasable attachment to a vertical support.

The sidewall members 12 and 13 are unitary with the shelf 16 and they extend upwardly at right angles to provide parallel supports which are joined along their longitudinal edges to back panel 14 by welding or similar means. Secured to the rearside of back panel 14 is a flat sheet of compressible material 23 such as felt, polyurethane or the like for cushioning the assembly against a wall or other vertical support.

Joined to the underside of said shelf 11 is an L-shaped flange 26 in which the vertically disposed segment 15 is equipped with a plurality of apertures for receiving and securing rods 17, 18, 19 and 20 at one end. At their opposite ends rods 17–20 are joined to the back panel member 14 by suitable means but a preferred embodiment provides for utilizing flat headed pem screws impressed within said panel member for engagement with the threaded apertures of rods 17, 18, 19 and 20.

The shelf 11 extends outwardly from back panel 14 and terminates in a vertically disposed segment 25 upon which indicia may be imprinted or secured for identification or instructional purposes.

The rods 17, 18, 19 and 20 are arranged in pairs as, for example, rod pairs 17 and 18 and rod pairs 19 and 20 to provide support for the envelope 30 and the hanger bar identified as 31 in FIGS. 1 and 3.

Each pair of rods is spaced apart from an adjacent rod pair by a suitable distance so that suspended files on adjacent pairs of rods will not overlap or intermesh. This suspension means is best illustrated by FIG. 1 which shows in detail a typical file prior to assembly and an assembled file in its suspended mode.

As shown in FIGS. 1 and 2 the envelope 30 is a flat receptacle equipped with a passageway 34 (FIG. 2) and cutout segments 32 and 33 (FIG. 1) through which the hook members 35 and 36 are exposed when the hanger has been fully inserted. The passageway 34 also includes a sealed stop 37 beyond which the hanger bar 31 cannot be inserted so that in its assembled mode there is perfect alignment between hook members 35 and 36 and the cutout segments 32 and 33. An unsecured flap 39 overlies the envelope opening 38 and provides a closure means. The envelope may be fabricated from any suitable material such as paper or plastic but a transparent plastic such as polyethylene or polypropylene is preferred.

Figure 4:
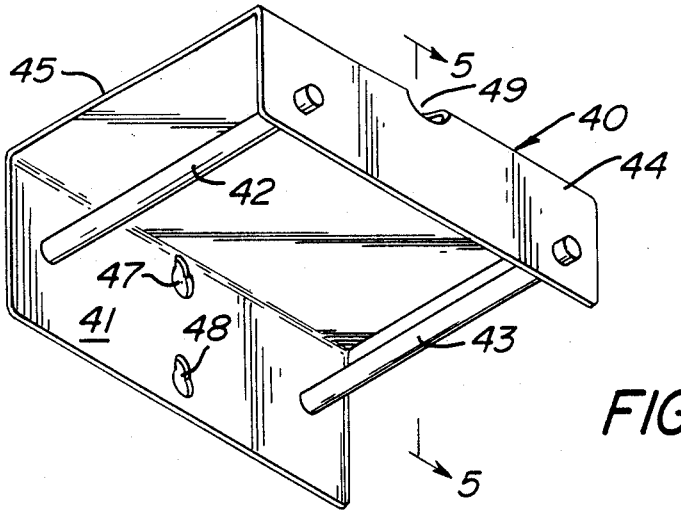
FIG. 4 is a perspective view of an alternative file assembly in accordance with this invention.
Figure 5:
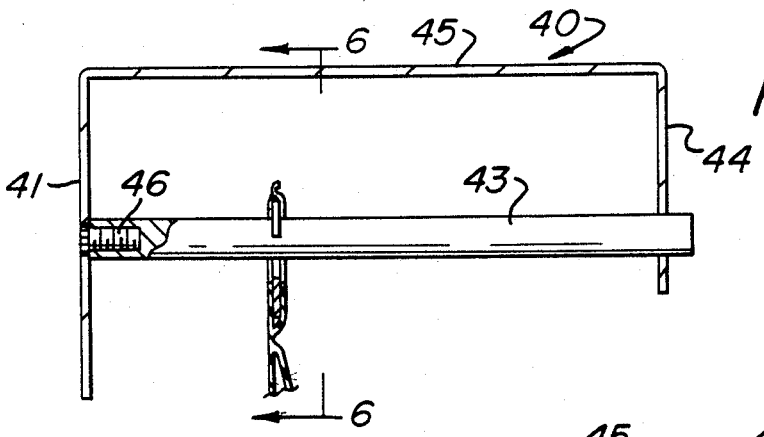
FIG. 5 is a side sectional view of the assembly shown in FIG. 4 along line 5—5.
Figure 6:
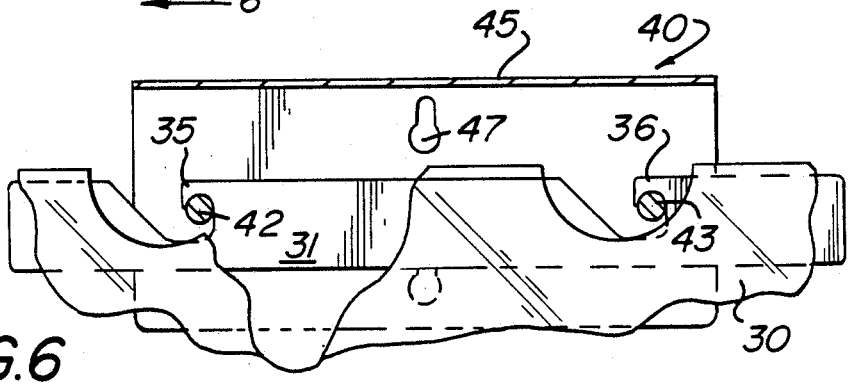
FIG. 6 is a fragmentary sectional view of the assembly shown in FIG. 5 along line 6—6.

In FIGS. 4, 5 and 6 there is shown an alternative assembly 40 designed for ease of installation and the convenient transport of files to a new location. This assembly consists essentially of a unitary member of inverted and generally U-shaped cross section in which the downwardly extending members 41 and 42 are joined by a single pair of horizontally disposed rods 42 and 43. One end of said rods are equipped with threaded cavities for engaging pem screws 46 within the back panel member 41 and they are supported at their opposite ends by engagement with accommodating apertures in front panel 44. The rods 42 and 43 are suitably spaced to accommodate the hook members 35 and 36 of bar 31 and the appended envelope 30 (FIG. 6).

Included in said back panel are several wall-mounting apertures 47 and 48 for frictionally engaging bolts or screws anchored into the wall or other support served by this appliance. A centrally disposed cutout 49 at the juncture between top panel 45 and front panel 44 provides a finger opening by which the assembly can be moved or carried to a new work area.

Figure 7:
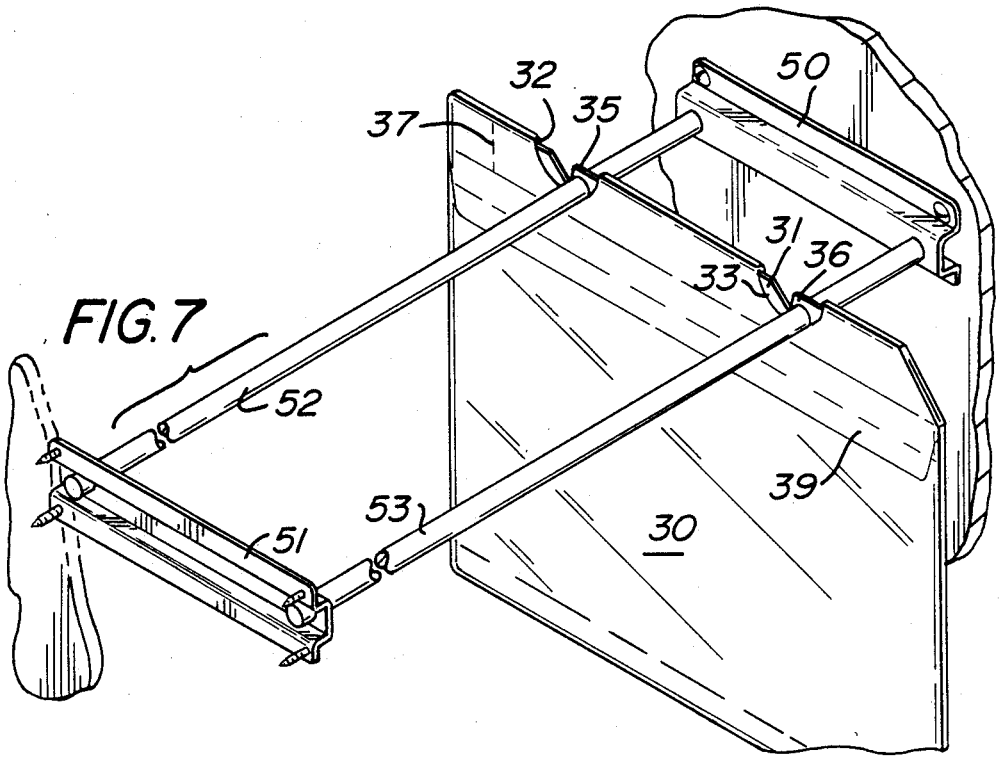
FIG. 7 is a perspective view of a dual supported file assembly.

FIG. 7 illustrates an alternative assembly which is not easily detachable. This device is a wall-mounted set-up consisting essentially of two plates arranged opposite one another to provide support for a pair of horizontally disposed rods 52 and 53. The plates 50 and 51 are characterized by an elongated structure of generally U-shaped cross section with ends that extend outwardly to form flanges that are equipped with apertures for receiving screws or other wall-retaining means. The parallel rods 52 and 53 are supported in their horizontal mode by the engagement of their respective terminal ends within the accommodating apertures of plate 50 and plate 51 and they are so uniformly spaced apart from one another as to engage precisely along their entire length the hook members 35 and 36 of hanger bar 31.

This invention has been described by reference to precise embodiments but it will be appreciated by those skilled in the art that this concept is subject to wide variation and modification and to the extent that these are within the skill of the artisan to effect, said variations and modifications are within the scope of the appended claims.

What is claimed is:

1. An envelope having an open end and an adjoining elongated passageway equipped with two semicircular cutouts, said passageway being adapted to receive a flat thin support bar in which there are formed two recessed segments which slope downwardly and terminate in hook members for engaging adjacent pairs of horizontally disposed rods, said recessed segments being disposed in such manner that they come into registry with said cutouts when said bar is slidingly inserted into said passageway.

2. The envelope according to claim 1 wherein said passageway receives said bar via a single end opening and includes a stop beyond which the bar cannot be inserted.

3. The envelope according to claim 1 wherein said recessed segments are open and angularly disposed for slidably guiding said rods onto said hook members.

4. A wall-mounted file assembly consisting essentially of:

(1) a unitary standard of inverted and generally U-shaped cross-section comprising:
  (a) a flat horizontally disposed top section;
  (b) a flat vertically disposed back panel member equipped with suitably spaced screw means for securing a pair of horizontally disposed rods; and
  (c) a vertically disposed front panel member equipped with apertures for engaging the opposite ends of said rods; and (2) a pair of horizontally disposed rods which extend at one end through the apertures of said front panel member and include at their opposite ends a threaded orifice for threadedly engaging said screw means.

5. The assembly according to claim 4 wherein said rods are circular in cross-section.

6. The assembly according to claim 5 wherein said screw means are pem screws housed within apertures in said back panel member.

7. The assembly according to claim 5 wherein said back panel member includes apertures for hanging said assembly on a wall-anchored support via screws, nails, bolts, hooks or the like.

8. A wall-mounted file assembly consisting essentially of:

(1) a unitary standard of inverted and generally U-shaped cross-section comprising:
  (a) a flat horizontally disposed top section;
  (b) a flat vertically disposed back panel member equipped with suitably spaced screw means for securing a pair of horizontally disposed rods; and
  (c) a vertically disposed front panel member equipped with apertures for engaging the opposite ends of said rods; and (2) a pair of horizontally disposed rods which extend at one end through the apertures of said front panel member and include at their opposite ends a threaded orifice for threadedly engaging said screw means; and (3) an envelope having an open end and an adjoining elongated passageway equipped with two semicircular cutouts, said passageway being adapted to receive a flat thin support bar in which there are formed two recessed segments which slope downwardly and terminate in hook members for engaging adjacent pairs of horizontally disposed rods, said recessed segments being disposed in such manner that they come into registry with said cutouts when said bar is slidingly inserted into said passageway.

* * * * *